US006060820A

United States Patent [19]

Noll et al.

[11] Patent Number: 6,060,820

[45] **Date of Patent: *May 9, 2000**

[54] REFLECTOR LAMP

[75] Inventors: Thomas Noll, Kipfenberg; Roland Stark, Wellheim; Josef Bauer, Walting, all of Germany

[73] Assignee: Patent-Treuhand-Gesellschaft fuer elektrische Gluehlampen mbH, Munich, Germany

[ * ] Notice: This patent is subject to a terminal disclaimer.

[21] Appl. No.: 08/973,702

[22] PCT Filed: Apr. 12, 1997

[86] PCT No.: PCT/DE97/00750

§ 371 Date: Dec. 8, 1997

§ 102(e) Date: Dec. 8, 1997

[87] PCT Pub. No.: WO97/40511

PCT Pub. Date: Oct. 30, 1997

[30] Foreign Application Priority Data

Apr. 19, 1996 [DE] Germany ..... 296 07 132 U
Nov. 20, 1996 [DE] Germany ..... 296 20 098 U

[51] Int. Cl.[7] ..... H01K 1/26

[52] U.S. Cl. ..... 313/113; 313/318.09; 313/318.1; 313/318.11; 439/611

[58] Field of Search ..... 313/113, 331, 313/332, 623, 624, 625, 634, 318.01, 318.11, 318.12, 579; 439/611, 337

[56] References Cited

U.S. PATENT DOCUMENTS

| | | | |
|---|---|---|---|
| 4,132,922 | 1/1979 | Newton et al. | 315/73 |
| 4,797,794 | 1/1989 | Connor et al. | 362/226 |
| 4,855,634 | 8/1989 | Gagnon et al. | 313/113 |
| 4,914,342 | 4/1990 | Mujahid et al. | 313/113 |
| 4,935,660 | 6/1990 | Heider et al. | 313/25 |
| 5,534,742 | 7/1996 | Krapp et al. | 313/113 |
| 5,542,857 | 8/1996 | Hume et al. | 439/337 |
| 5,883,469 | 3/1999 | Noll et al. | 313/579 |

FOREIGN PATENT DOCUMENTS

| | | |
|---|---|---|
| 0420431 | 4/1991 | European Pat. Off. . |
| 0572400 | 12/1993 | European Pat. Off. . |
| 0802561 | 10/1997 | European Pat. Off. . |
| 3110395 | 4/1982 | Germany . |
| 8234509 | 4/1984 | Germany . |
| 9102566 | 5/1991 | Germany . |
| 29607132 | 7/1996 | Germany . |
| 19548521 | 6/1997 | Germany . |
| 9214967 | 9/1992 | WIPO . |

OTHER PUBLICATIONS

Patent Abstracts of Japan, vol. 095, No. 011, Dec. 26, 1995.

*Primary Examiner*—Vip Patel
*Assistant Examiner*—Joseph Williams
*Attorney, Agent, or Firm*—William E. Meyer

[57] ABSTRACT

A reflector lamp may be made with a reflector and base holding a hermetically sealed bulb. The bulb encloses a filling and a light source, the light source being a high voltage or medium voltage light source in which an operating voltage of at least 80 volts is present. The reflector consists of a basic body with a reflector contour and a neck part attached to a rear portion of the basic body, and a base which is joined to the neck part and which has at least two metallic contact pins with cylindrical seals on an end farthest from the bulb. A current feeder system makes an electrical lead available for use by the light source. The base is formed completely from the same material as the neck part and as an integral part directly on the neck part of the reflector.

22 Claims, 2 Drawing Sheets

REFLECTOR LAMP

Reference is made to the parallel application in Europe, EP-PA 97 105 626.2 and the corresponding ones which are based on DE-GM 296 07 132. Reference is expressly made to the latter.

1. Technical Field

The invention relates to electric lamps and particularly to electric lamps with reflectors. More particularly the invention is concerned with an internal mounting for an electric lamp to a reflector.

2. Background Art

Such a reflector lamp is already known, for example, from EP-A 572 400. There it was a matter of an incandescent lamp whose base is partially formed by an insert part on the end of the neck part of the reflector. This insert part must be attached to the neck part of the reflector by means of cement. The disadvantages of this base are that it is difficult to produce and does not fit very precisely. In addition, this type construction leads to an increase of the overall length of the reflector lamp, since space is needed to secure the insert part underneath the bulb in the neck portion.

Another base principle for contact pins with cylindrical thickened portions is described in DE-GM 82 34 509. There the cap for a low pressure discharge lamp is a separate part made of plastic.

It is the object of this invention to construct at a reasonable cost a reflector lamp and to lower the production costs.

DISCLOSURE OF THE INVENTION

A reflector lamp may be made with a reflector and base holding a hermetically sealed bulb. The bulb encloses a filling and a light source, the light source being a high voltage or medium voltage light source in which an operating voltage of at least 80 volts is present. The reflector consists of a basic body with a reflector contour and a neck part attached to a rear portion of the basic body, and a base which is joined to the neck part and which has at least two metallic contact pins with cylindrical seals on an end farthest from the bulb. A current feeder system makes an electrical lead available for use by the light source. The base is formed completely from the same material as the neck part and as an integral part directly on the neck part of the reflector.

The special value of the invention consists in the production of the lamp being significantly simplified and simultaneously the possibility being created of making the lamp more compact and in particular guaranteeing a high degree of operating safety for the lamp. The reflector lamp of this invention possesses significant cost and manufacturing advantages over the prior art.

Either a luminous element or an electrode is possible as the means of illumination (see for example the reflector discharge lamp in U.S. Pat. No. 4,935 660). The invention is especially suited for high voltage and medium voltage lamps. Use of the invention for low voltage lamps, however, is not ruled out.

A special advantage is the concept of the integrated base which makes it possible to so organize the lead wire system that there are no contact problems due to contact resistances which frequently occur in the low voltage range (below 80V) because of smaller contact surfaces for electrical connections. Consequently corrosion caused by age causes the high contact resistance which results in voltage drops in the supply lines. During operation a markedly lower voltage is applied to the means of illumination.

BEST MODE FOR CARRYING OUT THE INVENTION

Figure 1:
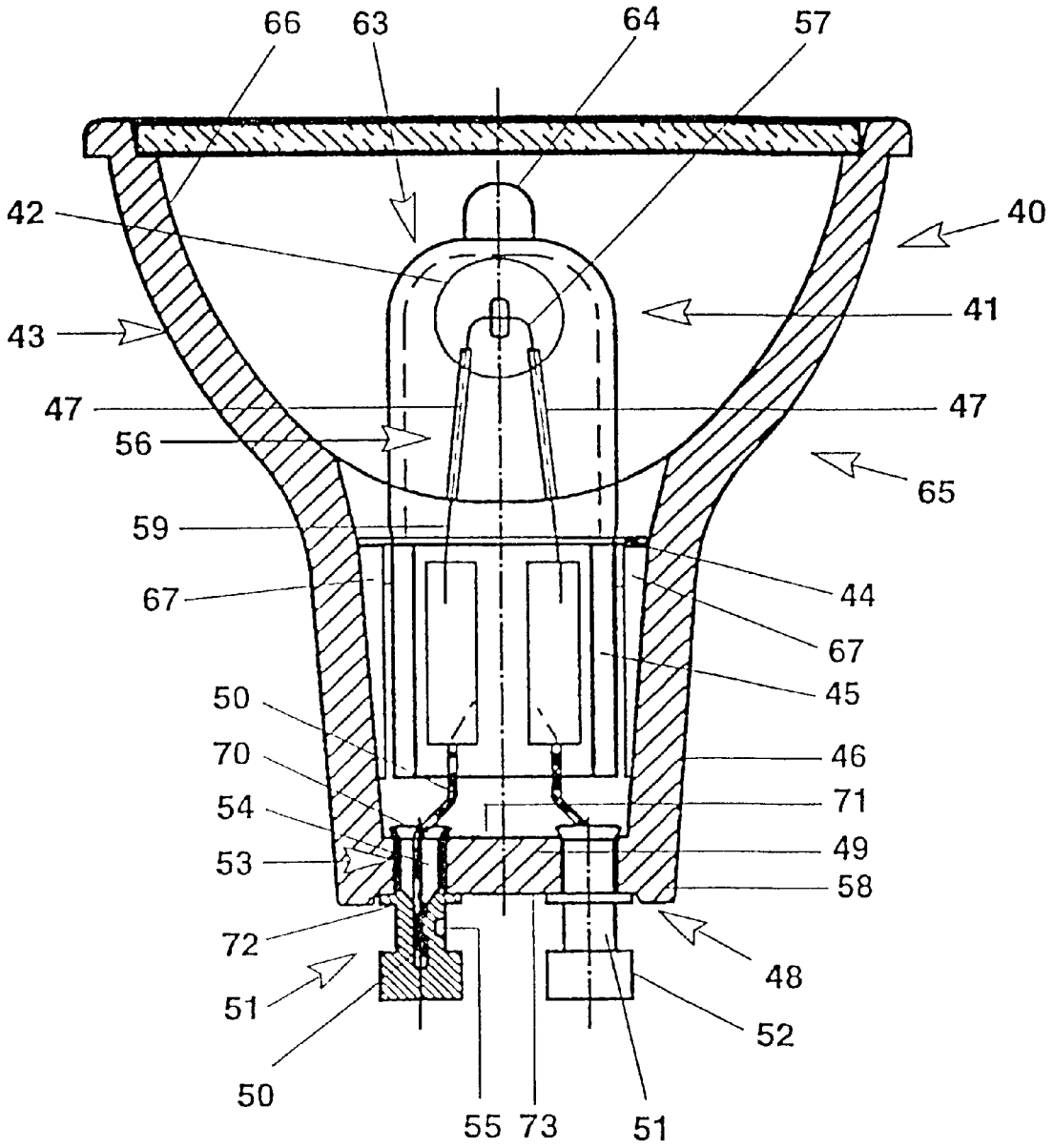
FIG. 1, shows a preferred embodiment of an incandescent reflector lamp.

Specifically the reflector lamp with a base on one side has the following features: a hermetically sealed bulb with a filling and a means of illumination, a reflector, consisting of a basic body bearing a reflector contour and a neck part placed on the basic body's back, a,base which is attached to the neck part and incorporates two or more metal contact pins with cylindrical thickened portions on the end away from the bulb, and a lead wire system which makes an electric supply line available for the means of illumination. The base is completely formed by the material of the neck part and is formed as an integral part directly on the neck of the reflector.

The bulb in the reflector lamp of this invention is usually a separate part made of hard glass or quartz glass inside the reflector which is pinched on one or two sides. It cannot, however, be ruled out that the bulb is formed by the reflector itself, in which case the reflector incorporates a hermetically sealed covering disk (sealed beam technology).

Usually a reflector lamp incorporates a reflector made of glass, but temperature resistant plastic is also suitable. These materials hold their shape better and have tighter tolerances than do ceramic materials, so the base rests better and more exactly in the holder. In addition ceramic is more expensive and heavier.

The invention is especially suited for high voltage and medium voltage lamps or, in other words, for an operating voltage of at least 80. Up until now the compactness of reflector lamps suitable for this left much to be desired.

In particular the base is formed by a plane wall with an interior and exterior face which is located crosswise to the reflector axis and closes off the neck piece. It incorporates openings parallel to the axis for contact pins.

It is advantageous to construct the contact pins as contact pin cases with interior bored holes, with the bored holes in the case extending over at least a portion of the length of the case or along its entire length.

The securing of the contact pin cases can occur in a simple manner in that the cases incorporate on the bulb side an outwardly bent edge and, approximately in the center of the case's length, a disk-like collar between which the wall of the base is locked.

In order to preclude problems when inserting into the holder, it is useful to place at least one raised bulge on the outer face of the wall, the thickness of which bulge equates to at least (equal is preferred) that of the collar of the case.

An especially interesting possibility of use for general illumination is a reflector lamp in which the lamp is an incandescent lamp with a bulb pinched on one side which contains a luminous body and internal lead wires, with the lead wires being so constructed, that they possess an inherent fusing effect.

Possible configuration possibilities for inherent fuses are described in a variety of documents:

Especially advantageous are inherent fuse s constructed as follows: the internal lead wires connect the ends of the luminous bodies to the sealing foils embedded in the pinch and are embedded in the pinch over at least a part of their length, with at least one of the lead wires consisting of an uncoiled wire. The inherent fuse effect is attained in that at least one of the two internal lead wires is made from a wire with a diameter of 130 $\mu$m at most, preferably 80 $\mu$m at most, which is embedded in the pinch over a length of at least 2 mm, and with the distance, d, between the lead wires and the applied voltage, V, so interacting that, in the event of an arc between the lead wires, the field strength effective there, V/d, is greater than 100 V/cm, but preferably is between 200 and 400 V/cm. Additional details can be found in DE-GM 296 07 132.

A specific advantage of an uncoiled wire in comparison to a single-coiled wire is that, when both wires are embedded in the pinch over an equal length, the mass of the lead wire made from the uncoiled wire is significantly less than the mass of the lead wire made from the single-coiled wire. The evaporation of the wire material in the capillary thus advances much more quickly. The arc extinguishes sooner and the response time of the inherent safety fuse is much shorter than for other safety fuses. In addition, the energy in the arc is considerably lower.

The concept of an "uncoiled wire" also includes a wire that originally was single-coiled, but which was pulled in its length, so that a helically coiled wire pulled in its length results. The pitch typically is of 10 to 100 times the wire diameter. The wire then has not completely lost its original helical shape, but the turns are pulled so far apart that during pinching a hose-like cavity no longer arises. At equal pinched lengths of the internal lead wires, the length of wire actually accommodated is thus markedly longer than for a completely uncoiled piece of wire for which the actual accommodated wire length is identical with the pinched wire length.

The internal lead wire preferably has a diameter of more than 15 $\mu$m. Frequently the luminous body and the internal lead wires can be constructed as a unit from a single wire., i.e., the internal lead wires are the uncoiled luminous body ends. It is, however, also possible to use separate internal lead wires with a different diameter as compared to the luminous body wire.

Other possibilities for an inherent safety fuse at high operating voltages are known, for example, from U.S. Pat. No. 4,132,922 and DE-GM 91 02 566. Here the lead wires consist of singly coiled sections which are embedded in the pinch, with their core region leaving a hose-like cavity that acts like an exhaust channel in case an arc forms.

Another solution for the problem is recommended in DE-OS31 10 395, namely, to incorporate an additional, so-called, thermal fuse in the pinch region of a halogen incandescent lamp pinched on one or two sides. It basically is a matter of a cavity which is formed in the region of the pinch and through which the internal lead wire is passed over a part of its length. Therefore since the lead wire is not embedded in the glass, the lead wire heats up very quickly and melts through.

Special advantages with regard to cost and production can be achieved when, on principle, the use of base cement is omitted. An elegant solution consists of using a lamp in which the bulb is pinched on one side, with the pinch being supported in the neck area of the reflector by means of a surrounding perforated disk made of a spring sheet steel.

With the integral base introduced here, the wall normally is placed on the neck piece at a right angle. The base can, however, be so constructed, that the neck part transitions over a radially circumferential bevel into the plane wall.

A highly compact reflector lamp with a cap on one side manifests the following features:

- a separate bulb of quartz glass hermetically sealed by a single pinch,
- a glass reflector,
- a luminous body with two ends bent in a U, V or W shape and held in the bulb without any mount construction (wire mount, quartz cross-piece). The latter point is usually difficult to realize in high or medium voltage lamps.

A particularly elegant possibility of not using a wire mount consists of fixing the luminous body in a known manner with at least one heat resistant means of support.

A high degree of compactness is especially difficult to attain in high voltage or medium voltage lamps, since they are normally operated with a safety fuse. Hence the operating voltage amounts to at least 80 V. The lead wire system therefore advantageously manifests internal lead wires which are so constructed that they possess an inherent safety fuse effect.

Finally the concept in this invention allows very short overall lengths, which up to this point seemed illusory for high voltage reflector lamps, namely overall lengths of equal to or smaller than 60 mm, and preferably even about 50 mm.

The luminous body in an incandescent lamp pinched on one side can be mounted axially or in can be bent in a U, V or W shape. An especially preferred embodiment finds the luminous body split into two luminous sections which are separated from each other by a non-luminous base piece. Lamps pinched on one side and incorporating an axial luminous body are used in particular for the medium voltage applications (system voltages of about 110 V). Here it is advantageous to connect only the end of the luminous body located next to the pinch with the sealing foil via a lead wire with an inherent safety fuse effect. The other lead wire which is led as the mount wire to the end farthest from the pinch is a solid wire.

Preferably the luminous body is supported by means of a heat resistant supporting means which can withstand an arc, for example, a solid wire mount or, preferably, glass webs which are formed from the material of the bulb.

The lamp of this invention can be produced at a favorable cost, since few component parts are needed and production can be easily automated.

All in all, a reflector lamp has been introduced which is characterized by improved operating safety and previously unattained compactness.

The reflector lamp of this invention is especially suited for direct operation off a system voltage, by which a range from approx. 80 to 250 V is to be understood. Typical wattages are 25 to 150 Watts. Because of its compactness this lamp can be used for many applications (e.g. PAR lamps, aluminum plated reflector lamps, cold light reflector lamps).

FIG. 1 shows a compact high voltage reflector lamp 40 for general illumination purposes with a power of 50 W which is suited for direct connection to a 240 V system. Its total overall length amounts to only 49 mm. The burner has a cylindrical bulb 41 of quartz glass with an outer diameter of about 13.5 mm, an inner diameter of 11 mm and an overall length of about 38 mm (prior art 86 mm).

One end of the bulb 41 forms a dome 63 which incorporates an exhaust tip 64 in the center. The other end of the bulb is closed with a pinched seal 45. The bulb is filled with an inert gas mixture of 80% Kr and 20% N to which a halogen additive of 0.005% $CBrClF_2$ is added.

A tungsten luminous body 56 bent approx. in a U-shape extends over almost the entire interior length of the bulb volume, with the base part 57 of the "U" which extends crosswise to the lamp axis being located in the vicinity of the dome 63, whereas the two legs of the "U" which form the actual luminous filament sections 47 extend from the base part 57 to the pinched seal 45 and thereby open slightly in an outward direction toward the pinched seal 45. The two luminous filament sections 47 transition at their ends into short, about 4 to 7 mm, uncoiled wire sections 59 which function as internal lead wires with an inherent safety fuse effect. The internal lead wires 59 are melted into the pinched seal 45 over a short length (typically 3 mm or less) and are welded there to the molybdenum sealing foils 60. The lead wires 59 extend several millimeters out of the pinched seal (typically 3 to 5 mm) and into the volume of the bulb.

The exterior lead wires 50 which extend out of the pinched seal 45 are welded to the external ends of the foils 60. They are angled off in an outward direction and threaded into the bored holes 54 of the contact pin cases 51. The cases 51 have cylindrical thickened portions 52 on the end.

The base part 57 of the "U" is uncoiled. It is arranged crosswise to the lamp axis just below the exhaust tube tip 64. Its ends are bent at about 90 degrees and extend to the filament sections 47. The filament pattern shown with two short, parallel legs 47 located close next to each other, is advantageous for the lamp distribution in the reflector. The dimensions of both filament legs are about 0.5×9.5 mm.

The luminous element is fixed at the level of the base part 57 by a single, oval glass web 42 which is made from the material of the bulb. The base part 57 is pinched in the glass web 42.

In this manner extreme compactness of the lamp is achieved. All in all, the bulb attains an overall length of only 38 mm, calculated from the pinch to the exhaust tube tip. The bulb can therefore be housed in a very compact reflector 43 of (hard) glass with an outer diameter of 50 mm.

The reflector of borosiliacte glass consists of a basic body 43, which is shaped like a spherical cap and has an interior contour 66, as well as the neck part 46 being placed on the basic body's back. The contour is coated with aluminum or a thin interference filter system. The latter is effective as a cold light mirror. The reflector opening is closed by a covering disk 61.

To better fix the bulb a springy, light weight arched, perforated disk 44 made of sheet metal is used which is located at the level of the pinch attachment 45 on the bulb. It has an opening adapted for the pinch and two guide clips located on the narrow sides of the pinch. The perforated disk 44 rests on four, long bulges 67 parallel to the axis (only two are visible in FIG. 1) which protrude from the neck 46 of the reflector. The attaching of the bulb occurs without any cap cement, in that the spring effect of the perforated disk is used (similar to the description in DE-GM 195 48 521). The bulb is thus placed into the neck part under pressure and then the external lead wires are crimped to the cases.

The reflector tapers toward the end of the reflector neck 46 and to an outer diameter of 20 mm. The total length of the reflector lamp is 49 mm.

To shorten the overall length, the reflector lamp has a glass cap 48 formed directly on the reflector neck. This consists essentially of a plane wall 49 at the end of the reflector neck, which functions as an integral bottom part. The external lead wires 50 of the built-in lamp are led outward through two openings 53 and are thereby threaded into the bored holes 54 of two metal contact pin cases 51 resting in the openings 53 The bored holes extend over a part of the length of the case, with the external lead wires 50 being crimped (55) into the case 51 (alternatively they can be soldered into a bored hole which passes all the way through).

The contact pin cases 51 themselves are pinned into the openings 53 in that the inner edge 70 of the case is bent around the inner face 71 of the wall and simultaneously a disk-like collar 72 formed on the center of the case rests on the outer face 73 of the wall. The two contact pin cases 51 have a center separation of 10 mm.

Customary reflector lamps for high or medium voltage operation usually incorporate in the lead wire system between the spherical reflector cap base and the base a safety fuse which most often inserts into a separate interim part (by means of cement). It is advantageous not to use that concept, instead the internal lead wire is an uncoiled wire with a wire thickness of about 100 $\mu$m, by which the internal lead wire acts as an inherent safety fuse. The overall length is thereby further reduced.

In an especially advantageous embodiment two flat, strip-like bulges 58 are placed opposite each other crosswise (or longitudinal) to the two contact pin cases 51 on the outer edge of the outer face 73. The thickness of the bulges 58 matches exactly the thickness of the disk-like collars 72, so that their respective end surfaces away from the bulb together define a plane (as a type of working distance). In principle the thickness of the bulges can be selected larger than that of the collars; that however increases the overall length of the lamp.

Thus any tilting of the contact pin cases 51 as in customary holders (see, for example, FIG. 4 of EP-A 572 400) can be avoided. As is known the holders incorporate two long, light weight circular, arched, slit-like openings (or recesses) on one of whose ends is located an enlarged circular opening to insert the contact pin cases 51. When inserting the cases 51 in these enlarged openings, the strip-like bulges serve, on the one hand, as a separator, so that the cases do not touch the floor of the recess and therefore remain easily movable for the following turning motion. On the other hand, the collars can not unintentionally be inserted into the enlarged opening of the holder where they would hang up when turned. Finally the strip-like bulges cause a release of pressure for the cylindrical thickened portions when the base is turned in the holder, thereby reducing the resistance during turning.

Figure 2:
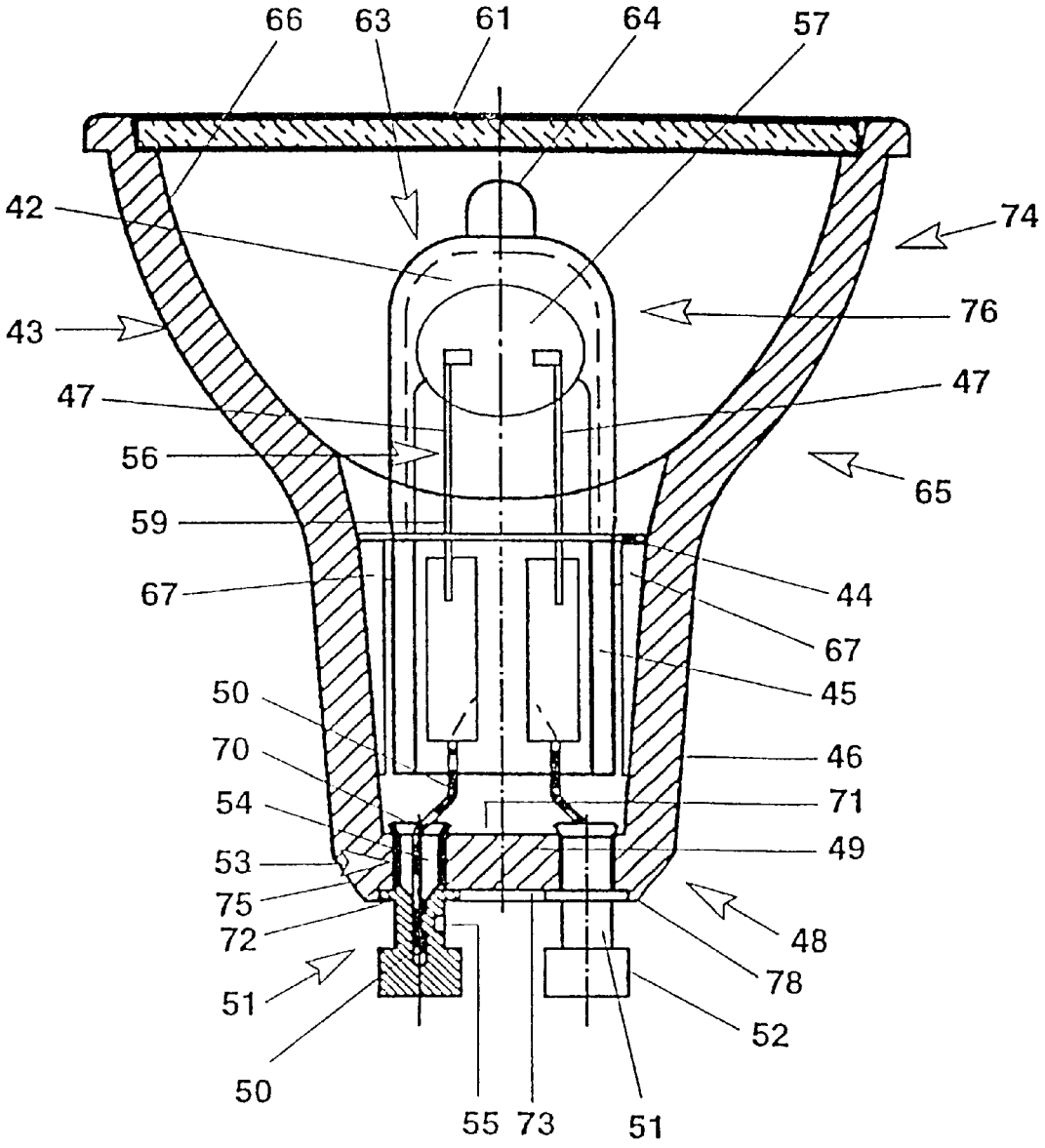
FIG. 2, shows a preferred embodiment of a discharge reflector lamp.

FIG. 2 shows a reflector lamp 74 with an arc tube 76 designed as a metal halide lamp pinched on one side which is further insulated by an outer bulb. Instead of several strip-like bulges, one (or several) ring-like bulges 78 are located on the outer edge of the wall 49. The transition between the neck part 46 and the external face of the wall 49 is not at a right angle, but instead is made by means of a radial, circumferential bevel 75. All other characteristics of this lamp resemble those of the incandescent lamp of the first embodiment and have the same reference signs.

This present invention has particular advantages over currently known reflector lamps, since not only the number of component parts (now six parts; prior art ten parts including the interim part) is reduced but also the assembly technology can be simplified. The new product can therefore be produced at a reduced cost, with less material and in less time.

In another embodiment of a reflector lamp for 110 V the luminous element is axially mounted and only the lead wire which leads to the end facing the pinch is melted as an uncoiled wire section into the pinch. For low voltage incandescent lamps the short luminous element is mounted either axially or crosswise to the axis.

The invention makes available, in particular, a reasonably priced reflector lamp with low power usage down to 25 W or even less for direct electrical system connection (high voltage, medium voltage) such as is of special interest for general illumination. Preferred wattages are 250 W at the most.

The invention is especially advantageous for low power (up to 75 W) halogen incandescent lamps pinched on one side, because the use of a glass base here demonstrates most dramatically the invention's savings of money and space.

The invention is not limited only to the embodiment shown. It is also well suited for use in halogen incandescent lamps operating off a 110 V electrical system. It is also suited for use in other types of incandescent lamps and discharge lamps.

What is claimed is:

1. A reflector lamp (40) with a base on one side comprising:

a hermetically sealed bulb enclosing a filling and a light source, the light source being a high voltage or medium voltage light source in which an operating voltage of at least 80 volts is present, a reflector (43), consisting of a basic body with a reflector contour (66) and a neck part (46) attached to a rear portion of the basic body, and a base (48) which is joined to the neck part and which has at least two metallic contact pins (51) with cylindrical seals (52) on an end farthest from the bulb, a current feeder system which makes an electrical lead available for use by the light source, wherein the base (48) is formed completely from the same material as the neck part and as an integral part directly on the neck part of the reflector.

2. The reflector lamp (40) in claim 1 wherein the bulb (41) is a separate part made of hard glass or quartz glass inside the reflector, and the bulb is pinch sealed on one end.

3. The reflector lamp (40) with a base on one side as in claim 2, wherein the light source is an incandescent light source with a bulb (41) pinched on one end which contains a luminous body (56) and an internal power leads (59) whereby the power leads are so fashioned that they possess an inherent safety fuse effect.

4. The reflector lamp (40) in claim 1 wherein the bulb (41) is a separate part made of hard glass or quartz glass inside the reflector, and the bulb is pinch sealed on two ends.

5. The reflector lamp (40) with a base on one side as in claim 1, wherein the bulb is formed by the reflector itself, whereby the reflector incorporates a gas-proof sealed covering disk (61).

6. The reflector lamp (40) with a base on one side as in claim 1, wherein the light source is a filament.

7. The reflect or lamp (40) with a base on one side as in claim 1, wherein the light source is an electrode.

8. The reflector lamp (40) with a base on one side as in claim 1, wherein the reflector (43) is made of glass.

9. The reflector lamp (40) with a base on one side as in claim 1, wherein the base (48) incorporating a smooth wall (49) with an inner (71) and an outer face (73) which is arranged crosswise to the reflector axis and occludes the neck part (46) and which incorporates openings (53) for contact pins (51).

10. The reflector lamp (40) with a base on one side as in claim 9, wherein the contact pin case (51) incorporates on the bulb side an edge (70) bent outward and approximately in the center of the length of the case a disk-shaped collar (72) with the wall (49) locked between both.

11. The reflector lamp (40) with a base on one side as in claim 10, wherein the at least one raised bulge (58, 78) is placed on the outer face (73) of the wall whose thickness corresponds at least to that of the collar.

12. The reflector lamp (40) with a base on one side as in claim 9, wherein the neck part (46) transitions into the smooth wall (49) by means of a radial circular bevel (75).

13. The reflector lamp (40) with a base on one side as in claim 1, wherein the contact pin is formed as a contact pin case (51) with an interior bored hole (54) whereby the bored hole extends into at least a portion of the case length.

14. A reflector lamp (40) with a base on one side as in claim 1, having the following features with a high degree of compactness comprising:

a separate bulb (41) made of quartz glass hermetically sealed by a single pinch (45), a reflector (43) made of glass, and a filament (56) with two ends which has a U, V or W shape and is held in the bulb without any mount construction.

15. The reflector lamp (40) with a base on one side as in claim 14, wherein the at least one heat resistant mounting means (42) fixes the filament (56).

16. The reflector lamp (40) with a base on one side as in claim 15, wherein the internal power leads (59) connecting the ends of the filament with the sealing foil embedded in the pinch (45) and by them being embedded for a portion of their length in the pinch, whereby at least one of the power leads (59) consists of an untwisted wire, whereby the inherent safety fuse effect is achieved by at least one of the two internal power leads (59) being made from a wire with a diameter of at most 130 $\mu$m, which is embedded in the pinch over a length of at least 2 millimeters, whereby millimeters, whereby the distance, d, between the power leads and the voltage, V, present there so interact, that in the event an arc appears between the power leads, the effective field strength there, V/d, is greater than 100 volts per centimeter.

17. The reflector lamp (40) with a base on one side as in claim 16, wherein the ratio V/d is between 200 and 300 volts per centimeter.

18. The reflector lamp (40) with a base on one side as in claim 14, wherein the wire diameter is less than or equal to 80 $\mu$m.

19. The reflector lamp (40) with a base on one side as in claim 14, wherein the operating voltage amounting to at least 80 volts, whereby the current feeder system incorporates internal power leads (59) fashioned to possess an inherent safety fuse effect.

20. The reflector lamp (40) with a base on one side as in claim 14, wherein the overall length of the light source is smaller than or equal to 60 millimeters with the amount of 50 millimeters being preferred.

21. A reflector lamp (40) with a base on one side comprising:

a hermetically sealed bulb enclosing a filling and a light source, a reflector (43), consisting of a basic body with a reflector contour (66) and a neck part (46) attached to a rear portion of the basic body, and a base (48) which is joined to the neck part and which has at least two metallic contact pins (51) with cylindrical seals (52) on an end farthest from the bulb, a current feeder system which makes an electrical lead available for use by the light source, wherein the base (48) is formed completely from the same material as the neck part and as an integral part directly on the neck part of the reflector, wherein the bulb (41) is a separate part made of hard glass or quartz glass inside the reflector, and the bulb is pinch sealed on one end, and whereby the pinch (45) is supported by means of perforate disk (44) surrounding the pinch in the neck part of the reflector.

22. A reflector lamp (40) with a base on one side comprising:

a hermetically sealed bulb enclosing a filling and a light source, a reflector (43), consisting of a basic body with a reflector contour (66) and a neck part (46) attached to a rear portion of the basic body, and a base (48) which is joined to the neck part and which has at least two metallic contact pins (51) with cylindrical seals (52) on an end farthest from the bulb, a current feeder system which makes an electrical lead available for use by the light source, wherein the base (48) is formed completely from the same material as the neck part and as an integral part directly on the neck part of the reflector, wherein the bulb is a separate bulb (41) made of quartz glass hermetically sealed by a single pinch (45), wherein the reflector (43) made of glass, and wherein the light source is a filament (56) with two ends which has a U, V or W shape and is held in the bulb without any mount construction, and wherein the bulb is held in the reflector without cement, preferably by means of a perforated disk (44).

* * * * *